United States Patent [19]

Price et al.

[11] 4,432,294

[45] Feb. 21, 1984

[54] GARMENT FORMING METHOD AND APPARATUS

[75] Inventors: Elvin C. Price; Preston B. Dasher, both of Lawrenceville, Ga.

[73] Assignee: Atlanta Attachment Company, Lawrenceville, Ga.

[21] Appl. No.: 263,974

[22] Filed: May 15, 1981

[51] Int. Cl.[3] ..... D05B 35/06; D05B 97/00

[52] U.S. Cl. ..... 112/262.3; 112/152; 112/235

[58] Field of Search ..... 112/262.1, 152, 130, 112/235, 262.3

[56] References Cited

U.S. PATENT DOCUMENTS

| | | | |
|---|---|---|---|
| 2,907,291 | 10/1959 | Schrader | 112/235 X |
| 3,664,284 | 5/1972 | Hester | 112/152 |
| 4,224,350 | 6/1981 | Walter et al. | 112/235 |

*Primary Examiner*—H. Hampton Hunter
*Attorney, Agent, or Firm*—Thomas & Kennedy

[57] ABSTRACT

A presser foot assembly is mounted to a sewing machine and includes a bifurcated skid for mounting to the sewing machine in alignment with and projecting in front of the sewing station and a wheel mounted on the skid which is biased downwardly through the slot of the tines of the skid into yielding contract with the material extending through the sewing station. When a tape feed apparatus is moved to a position in front of and aligned with the wheel and the sewing station, the tape moves with the base material beneath the wheel and through the sewing station where it is sewn to the base material. When the tape feed apparatus is moved out of alignment with the wheel and sewing station, the tape no longer moves beneath the wheel and to the sewing station.

7 Claims, 6 Drawing Figures

GARMENT FORMING METHOD AND APPARATUS

BACKGROUND OF THE INVENTION

This invention relates to an attachment for a sewing machine, particularly a presser foot structure which includes a bifurcated skid and guide wheel which engage oncoming plies of material being moved to the needle of the sewing machine.

In the production of garments and similar objects, it is common practice to match two or more plies of material together and sew through the layers of material to form a seam. When functions of this type are performed on an industrial basis, wherein large numbers of garments are produced in an assembly line, it is important for the sewing machine operator to have equipment that assists in aligning the plies of material and that properly feeds the plies of material to the sewing station without direct operator control, so that the sewing function is expedited. It is important that the equipment used in the sewing function not only properly aligns the plies of material but also feeds the material under proper control conditions so as to avoid the gathering or "puckering" of one ply of material in the multiple layers of material. This is particularly critical when stretchable materials are being handled in the sewing process, such as knitted fabrics. If one ply of material is stretched more than another ply of material as the two plies are matched together and fed to the sewing station, it is likely that the relatively unstretched ply of material will be gathered in the finished product.

Also, in the construction of some garments, multiple plies of materials must be matched together with some of the plies being of shorter length than other plies. This requires the sewing machine operator to match some of the plies together and begin the sewing function, and part way through the sewing function to match another ply to the base ply and then continue the sewing function. Without the proper equipment, this requires the machine operator to interrupt the sewing function to match the shorter ply with the longer plies of material and then resume the sewing function.

SUMMARY OF THE INVENTION

Briefly described, the present invention comprises a method and apparatus for forming garments and the like wherein one or more plies of base material are sewn along their edges at a sewing station, and without interrupting the sewing function another ply of material is matched with the moving base material and moved with the base material into the sewing station, whereupon all the plies of material are sewn together. Also, the additional ply of material can be moved away from the base material as the sewing function continues, so that the additional ply of material no longer feeds to the sewing station.

In the particular embodiment disclosed, the plies of knit material that form a knitted shirt are matched together and moved as a base material to the sewing station, and during the feeding of the base plies of material a folded tape of knit material is moved onto the base plies of material and carried to the sewing station with the base plies of material, where all of the plies of material are sewn together. A folder is mounted above the sewing machine work table and its exit opening is movable laterally from a position to one side of the path of movement of the base material to a position over the path of the base material and in alignment with the sewing station, so that the tape material is fed directly onto the base material moving into the sewing station. Additionally, a presser foot assembly extends from the sewing station out in front of the sewing station so as to control the oncoming plies of material. The presser foot assembly includes a bifurcated skid or foot and a wheel that is freely rotatably mounted above the presser foot and protrudes downwardly between the tines of the presser foot so as to make rolling contact with the oncoming plies of material. The guide wheel is spring biased in a downward direction so as to make yiedling contact with the plies of material, and so as to accomodate varying thicknesses of material and to assist in directing the plies of material toward the sewing station without exerting drag to the top ply of material, and avoiding stretching the top ply of material during the in-feed function of the sewing machine.

Thus, it is an object of this invention to provide a method and apparatus for forming garments and similar items which enables the sewing machine operator to run the sewing machine continuously while moving a ply of material in matched relationship with the base plies of material so that the additional ply of material is accurately sewn into the base plies of material.

Another object of this invention is to provide a garment forming method and apparatus which includes a presser foot assembly having a freely rotatable wheel mounted thereon and biased downwardly with respect thereto into yielding engagement with plies of material moving beneath the presser foot assembly across the work table to the sewing station, so that the effect of drag by the presser foot against the top ply of material is minimized.

Another object of this invention is to provide a method and apparatus for forming garments and the like which includes a means for shifting a tape of material into the sewing path of a sewing machine during a continuous sewing operation and for accurately feeding the tape of material substantially without stretching the tape of material with respect to the base material as the feeding of all the plies of material progresses, so that the stitching of the plies of material together does not result in a gathering of any of the plies of the material.

Other objects, features and advantages of the present invention will become apparent upon reading the following specification, when taken in conjuction with the accompanying drawings.

DETAILED DESCRIPTION

Figure 1:
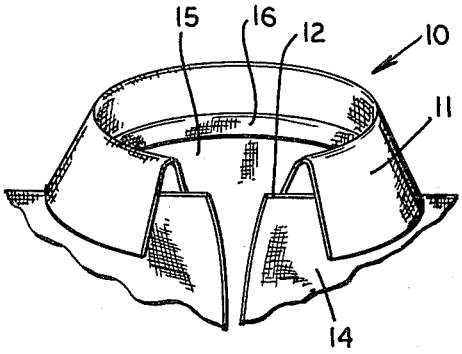
FIG. 1 is a view of the collar portion of a finished shirt formed by the method and apparatus hereinafter disclosed.

Referring now in more detail to the drawings, wherein like numerals indicate like parts throughout the several view, FIG. 1 illustrates a conventional shirt collar structure 10 wherein a collar piece 11 is sewn to the neck opening 12 of the front and back panels 14 and 15 of the garment. A tape 16 is sewn to and covers the connecting seam between the collar piece 11 and the front and back panels 14 and 15 of the garment.

Figure 2:
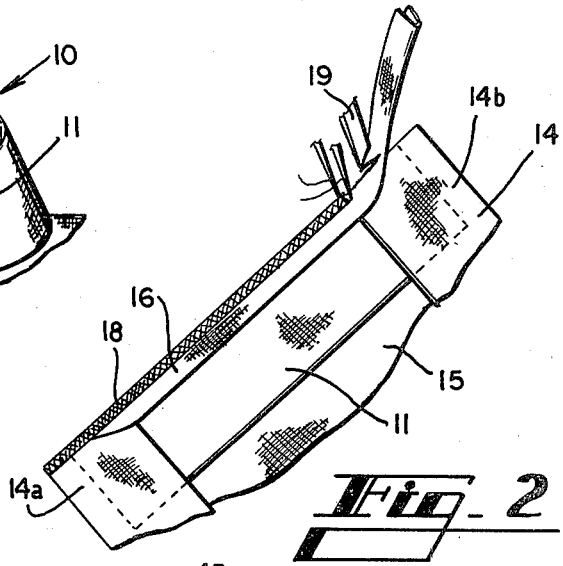
FIG. 2 is a layout of the collar portion of a shirt of FIG. 1, but showing the configuration of the collar structure just after it has been sewn together and before it is everted.

As illustrated in FIG. 2, the collar structure of FIG. 1 is formed by aligning an edge of the collar piece 11 with the edges of the front and back panels 14, 15 and sewing with an overedge stitch 18 along the aligned edges. During this sewing function, after the sewing machine has started forming the overedge stitching 18, a length of continuous tape material 16 is moved into the path of the collar piece 11 and front and back panels 14, 15 through the sewing station and fed with the collar piece and panels to the sewing station. The length of tape material 16 therefore is sewn by the overedge stitching to the other base pieces of material so that the tape 16 is attached to the assembly. Before the end of the base material 14, 15 is fed to the sewing station, the tape material 16 is guided off the edge of the base material, so that the tape 16 formed in the garment is substantially centered between the ends of the collar structure and projects slightly beyond the overfolded portions 14*a* and 14*b* of the front panel 14. The sewing machine includes a conventional mechanism 19 that cuts the material being fed to the sewing station at the line where the overedge stitching is to be formed. Therefore, the leading and trailing ends of the tape 16 are cut from the finished product. Therefore, when the garment of FIG. 2 is everted it looks like the collar structure shown in FIG. 1, and the tape 16 emerges from between the plies of material of the overfolded portions 14*a* and 14*b* of the front panel and extends about the overedge stitching 18. After the garment has been everted, the tape 16 usually is sewn to the front and back panels with an invisible stitching so that the tape 16 hides the overedge stitching 18.

Figure 3:
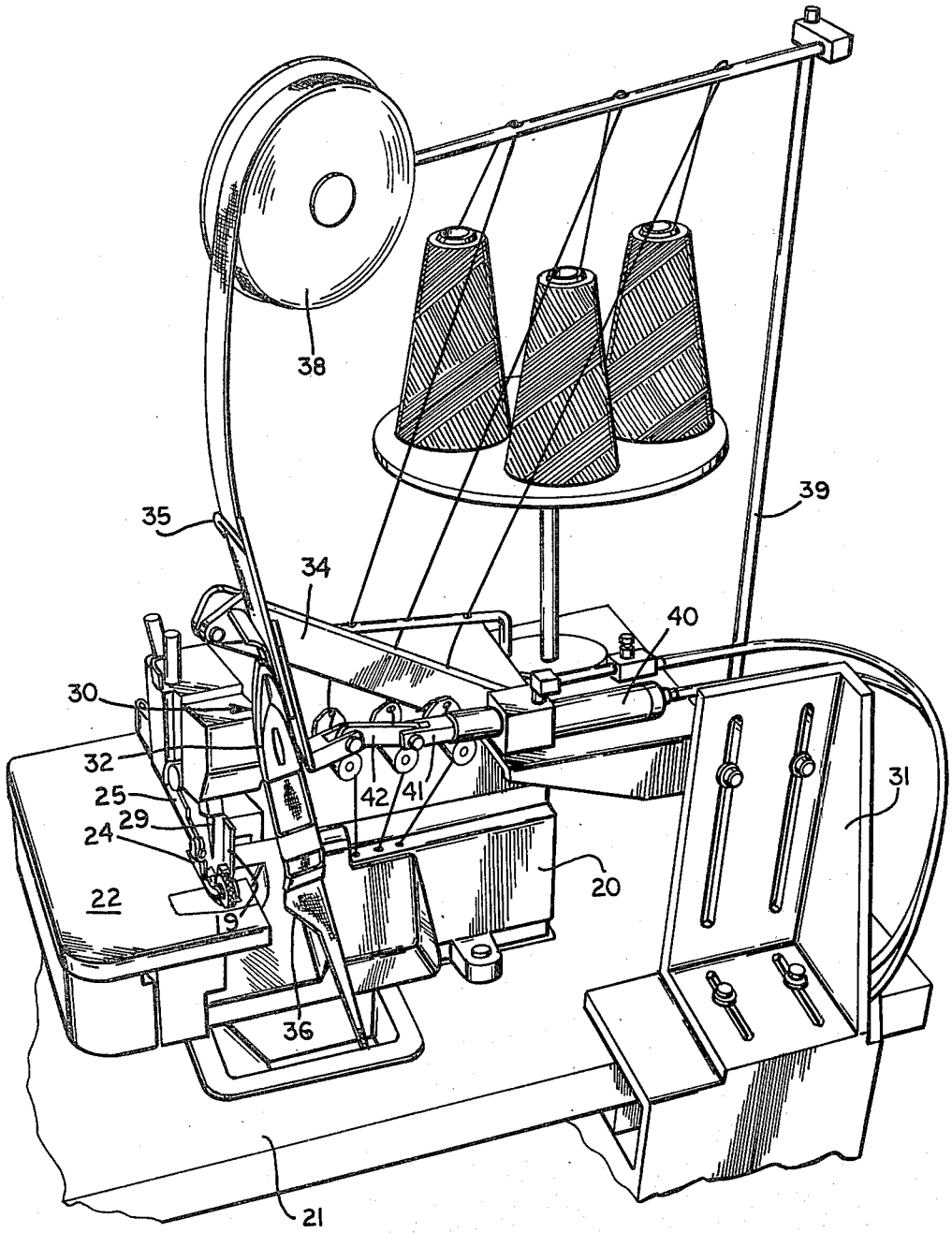
FIG. 3 is a perspective illustration of the apparatus for forming garments of the type illustrated in FIGS. 1 and 2, with the apparatus shown mounted to a conventional sewing machine.

As illustrated in FIG. 3, a conventional sewing machine 20 is mounted on a work table 21, and a work surface 22 is positioned about the needle area or sewing station 24. The particular sewing machine comprises a Wilcox and Gibbs sewing machine that functions to form overedge stitching; however, other conventional sewing machines can be used, as may be desired. Typically, the sewing machine will have a presser foot arm 25 (FIGS. 4 and 5) that is movable vertically as indicated by arrows 26, feeding means such as feed dogs 28 that protrude upwardly through the work surface 22 and oscillate to engage and feed the material through the sewing station, and one or more sewing needles 29 that reciprocate from above the work surface 22 to a level down beneath the work surface for engagement with a bobbin, looper or the other conventional elements of the sewing machine.

As illustrated in FIG. 3, tape guide assembly 30 is mounted to work table 21 by means of adjustable support bracket 31. Tape guide 30 includes folder 32 pivotally mounted at its upper end by inclined support arm 34 and which includes an upper inlet end 35 and a lower exit end 36. Folder 32 is of conventional construction and defines an open ended slot extending therethrough that merges from a substantially flat configuration at the upper inlet end to an approximately flat V-shape at its lower exit end. A supply of elongated material or tape 38 is supported from support stanchion 39 above folder 32. The supply 38 is formed in a reel with its free end extending downwardly through the folder 32 so that the reel supplies the folder and sewing machine with a continuous length of material during the operation of the sewing machine. The length of material of the reel 38 is knitted material, is relatively narrow, and as it moves down through folder 32, the material is folded into a V-shape with its free ends to move through the sewing station with its folded edge portion to overlie the remaining material projecting to the side of the sewing station. Thus, the material from the reel 38 forms the tape 16 (FIGS. 1 and 2) of a garment that will be manufactured by the sewing machine.

Fluid actuated cylinder 40 is mounted to the adjustable support bracket 31, and its cylinder rod 41 is connected to the mid-portion of folder 32 by linkage 42. Folder 32 is pivotally connected to the upper end of inclined support arm 34, so that when cylinder 40 is actuated, the lower exit end 36 of folder 32 pivots back and forth between a position beside the sewing path of the sewing machine to a position aligned with the sewing path of the sewing machine. Cylinder 40 is actuated with a conventional foot or knee switch (not shown), and the actuating mechanism can, for example, be controlled by a direct fluid pressure line extending from the actuating switch, or through a shuttle valve arrangement where the operator shifts folder 32 in one direction with one depression of the switch and then shifts the folder 32 in the opposite direction with another depression of the switch.

Figure 4:
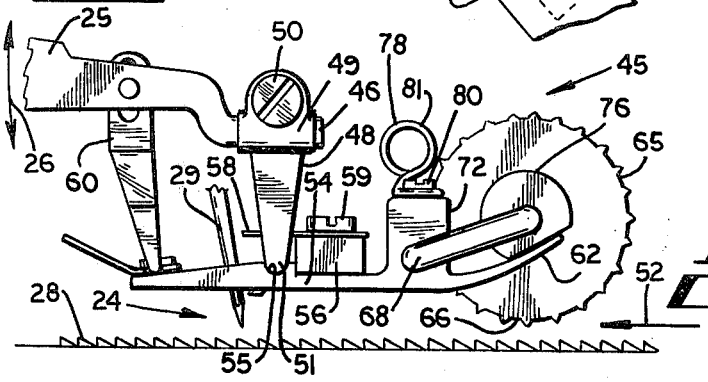
FIG. 4 is a side elevational view of the presser foot assembly which is a part of the apparatus of FIG. 3.
Figure 5:
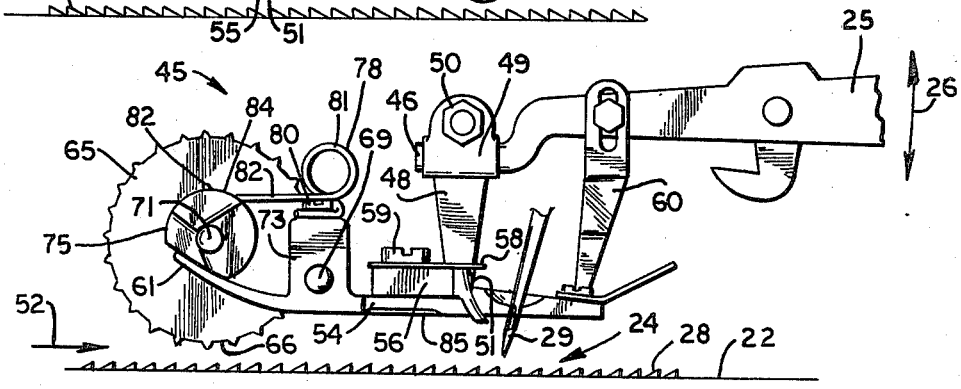
FIG. 5 is also a side view of the presser foot assembly, but illustrating the opposite side thereof.
Figure 6:
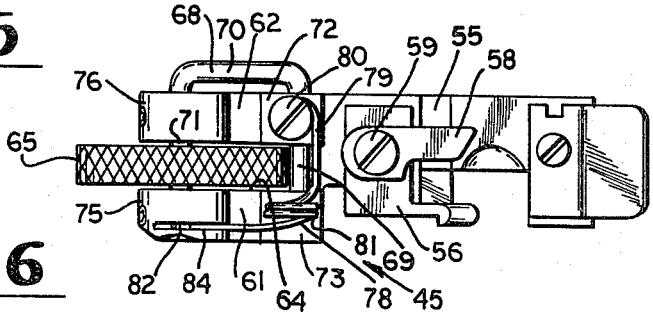
FIG. 6 is a top view of the presser foot assembly.

As illustrated in FIGS. 4, 5 and 6, a presser foot assembly 45 is mounted to presser foot arm 25 of the sewing machine. The presser foot arm 25 includes a projection 46, and a mounting arm 48 having a socket 49 at its upper end is attached to the projection 46. The socket 49 is a split socket and its diameter is reduced by screw 50 being threaded through the projecting ears of the socket. The lower end of mounting arm 48 is turned in an L-shape so as to form a horizontal support protrusion 51 that extends across the path 52 of the material that is to be sewn at the sewing station 24.

Presser foot assembly further includes a bifurcated foot or skid 54 mounted to the horizontal support protrusion 51 of mounting arm 48. Skid 54 includes a hemicylindrical recess 55 in its upper surface, a mounting block 56 next adjacent the recess 55 and an overhanging lock protrusion 58 pivotally mounted to mounting block 56 by connector screw 59. Connector screw 59 also rigidly mounts the mounting block 56 to the skid 54. With this arrangement, when the recess 55 of the skid is mounted to the horizontal support protrusion 51 of the mounting arm 48, the overhanging lock protrusion 58 is pivoted over the support protrusion 51 of mounting arm 48, thereby suspended the skid 54 from the mounting arm 48. The skid can pivot about support protrusion 51 in a vertical plane which is normal to the horizontal support protrusion 51. Since the presser foot assembly 45 is heavier at its front than it is at its back, a positioning arm 60 is rigidly attached at its upper end to presser foot arm 25, and its lower end abuts the rear portion of skid 54, so that the skid is maintained in the position illustrated in FIGS. 4 and 5 when the presser foot assembly is raised away from the work surface 22.

The forward projecting portion of skid 54 is bifurcated so that a pair of parallel tines 61 and 62 defines a slot 64 that is open at its front portion. Guide wheel 65 is supported by skid 54 with the lower portion 66 of guide wheel 65 protruding downwardly through the slot 64. U-shaped axle 68 includes a base leg 69, intermediate pivot leg 70 and axle leg 71. A pair of spaced mounting blocks 72 and 73 are rigidly connected to skid 54 and define aligned openings therethrough which receive the base leg 69 of the U-shaped axle 68. A pair of sockets 75 and 76 are mounted on axle leg 71 on opposite sides of guide wheel 65 so as to maintain guide wheel 65 in alignment with the slot 64 of the skid 54. L-shaped torsion spring 78 has one end thereof 79 rigidly connected to mounting block 72 by means of screw 80, its coil 81 positioned over the other mounting block 73 and its other end 82 in sliding engagement with socket 75. A recess 84 is formed in the upper surface of socket 75 so that the end portion 82 of the torsion spring 78 slides through the recess without displacement over the end of the socket.

The protruding tines 61 and 62 of the skid 54 are curved upwardly with respect to the relatively flat bottom surface 85 of skid 54, and the sockets 75 and 76 normally rest on the top surfaces of the tines 61 and 62. Spring 78 functions to urge guide wheel 65 downwardly so that its lower portion 66 normally protrudes downwardly through the slot 64 between the tines 61 and 62 of the skid 54 towards yielding engagement with the work surface 22 and any layers of material present on the work surface beneath the presser foot assembly 45. The spring 78 will yield so that the lower surface 66 guide wheel 65 can move to a level coextensive with the bottom surface of skid 54. The guide wheel 65 is freely rotatably held in this yielding relationship on the top surface of skid 54, so that when the layers of material are pulled through the sewing station 24 by the feed dogs 28, substantially no drag is applied to the layers of material by the guide wheel 65. When the pressure foot assembly is lowered into engagement with the material to be moved through the sewing station, the presser foot and guide wheel are moved at first in unison until the guide wheel makes firm engagement with the material, and the skid usually moves a little further down until spring 78 arrests further movement. Usually the skid will make light contact with the material. The guide wheel tends to hold the forward portion of the skid away from full contact with the material, thus reducing friction due to drag between the forward portion of the skid and the material. Since the feed dogs continually advance the base ply of material and the guide wheel 65 urges the upper ply of material downwardly into engagement with the lower base ply of material substantially without drag friction, the base ply of material will carry the upper ply of material with substantially no stretching of either of the plies of material with respect to each other.

While this invention has been described in detail with particular references to preferred embodiments thereof, it will be understood that variations and modifications can be effected within the spirit and scope of the invention as described hereinbefore and as defined in the appended claims.

We claim:

1. A method of forming a garment part and the like comprising progressively moving a base material across a work surface from in front of a sewing station through the sewing station, supporting a wheel and presser foot assembly at a position in front of the sewing station, biasing the wheel downwardly with respect to the presser foot assembly into engagement with the base material, freely rotating the wheel about a horizontal axis extending across the direction of movement of the base material in response to the movement of the base material toward the sewing station, moving a portion of a length of tape material laterally from beside alignment with the wheel and sewing station to a position in front of the wheel and in alignment with the wheel and sewing station and in contact with the base material so that the wheel rides over and holds the tape material against the base material and the movements of the base material and the wheel tend to feed the length of tape material under the wheel and beneath the presser foot assembly and into the sewing station in unison with the base material, sewing through the base material and the length of tape material at the sewing station, and then moving the portion of the length of tape material feeding toward the wheel laterally away from the position aligned with the wheel and sewing station so that the wheel rides off the tape material and the length of tape material is no longer fed by the base material and wheel into the sewing station.

2. The method of claim 1 and wherein the step of engaging the base material with a wheel comprises lowering a presser foot and the wheel in unison toward the base material with the lower surface of the wheel preceding the lower surface of the presser foot until the wheel engages the base material, and lowering the presser foot further with respect to the wheel until the presser foot engages the base material.

3. The method of claim 1 and further including the step of cutting the base material as it is fed into the sewing station to form an edge of base material that moves through the sewing station and cutting the length of tape material as the tape material is fed into the sewing station to form aligned edges of base material and length of tape material that moves through the sewing station, and wherein the step of sewing through the base material and the length of tape material comprises first sewing at the cut edge of the base material and then sewing at the aligned edges of the base material and the length of tape material as the length of tape material moves through the sewing station.

4. Apparatus for forming garment parts and the like for attachment to a sewing machine that includes a sewing station and sewing machine feed means at the sewing station to move base material from in front of the sewing station across a work surface through the sewing station, said apparatus comprising a presser foot assembly including a skid for positioning in alignment with and projecting in front of the sewing station, a wheel, means for rotatably supporting said wheel on said skid in alignment with the sewing station and including spring means for biasing said wheel downwardly with respect to said skid so that the lower portion of said wheel normally protrudes beneath said skid toward the work surface, tape feed means for moving an end portion of a length of tape material extending from a supply back and forth from a position out of alignment with said wheel laterally to a position closely adjacent and in front of said wheel to rest on the base material, whereby as base material is moved across the work surface and beneath the wheel and through the sewing station by the sewing machine feed means the movement of the length of tape material by the tape feed means to the position in front of the wheel on the base material results in the length of tape material moving onto and with the base material beneath the wheel and into the sewing station with the tape material pressed by the wheel into frictional engagement with the base material and moving in unison with the base material from the wheel into the sewing station, and the movement of the length of tape material by the tape feed means to the position out of alignment with the wheel results in the length of tape material moving laterally out of alignment with the wheel and the sewing station and off the base material.

5. The apparatus of claim 5 and wherein said presser foot assembly comprises a bifurcated skid defining a slot, an axle mounted to said bifurcated skid and movable with respect to said presser foot, said wheel rotatably mounted on said axle, and spring means for biasing said axle downwardly with respect to said presser foot to urge said wheel downwardly through said slot toward yielding engagement with the work surface.

6. Apparatus for forming garment parts and the like for attachment to a sewing machine that includes a sewing station and feed means at the sewing station to move base material from in front of the sewing station across a work surface through the sewing station, said apparatus comprising a presser foot assembly, a wheel rotatably mounted to said presser foot assembly for positioning in alignment with and in front of the sewing station, said presser foot assembly including a skid extending from said wheel for projecting toward the sewing station, tape feed means including a tape exit end movable back and forth from a position out of alignment with said wheel and to a position closely adjacent and in front of said wheel, whereby as base material is moved across the work surface and beneath the wheel and through the sewing station by the sewing machine feed means the movement of the base material causes the wheel to rotate and the movement of the free end of tape by the exit end of the tape feed means to the position in front of the wheel on the base material results in the wheel rolling over the tape material and the tape material moving with the base material beneath the skid into the sewing station.

7. The apparatus of claim 6 and further including spring means for biasing said wheel downwardly with respect to said presser foot assembly to a level lower than said skid for yieldable engagement with the base material and tape material, and wherein said wheel protrudes in front of the skid.

* * * * *